United States Patent [19]

Wurthman

[11] 4,395,655

[45] Jul. 26, 1983

[54] HIGH POWER GYROTRON (OSC) OR GYROTRON TYPE AMPLIFIER USING LIGHT WEIGHT FOCUSING FOR MILLIMETER WAVE TUBES

[75] Inventor: Gunther E. Wurthman, Lincroft, N.J.

[73] Assignee: The United States of America as represented by the Secretary of the Army, Washington, D.C.

[21] Appl. No.: 198,395

[22] Filed: Oct. 20, 1980

[51] Int. Cl.[3] ..... H01J 25/00

[52] U.S. Cl. ..... 315/4; 315/5; 315/5.35; 331/79

[58] Field of Search ..... 315/3, 4, 5, 5.35; 331/79

[56] References Cited

U.S. PATENT DOCUMENTS

| | | | |
|---|---|---|---|
| 2,879,439 | 3/1959 | Townes | 315/5 |
| 3,398,376 | 8/1968 | Hirshfield | 315/5 |
| 3,463,959 | 8/1969 | Jory et al. | 315/3.5 X |
| 3,789,257 | 1/1974 | Friedman et al. | 315/3 |
| 4,019,088 | 4/1977 | Budker et al. | 315/5 |
| 4,199,709 | 4/1980 | Alirot et al. | 315/3 |
| 4,224,576 | 9/1980 | Granatstein et al. | 315/3 |
| 4,253,068 | 2/1981 | Barnett | 315/3 |

*Primary Examiner*—Saxfield Chatmon, Jr.

*Attorney, Agent, or Firm*—Robert P. Gibson; Jeremiah G. Murray; Anne Vachon Dougherty

[57] ABSTRACT

An improved gyrotron oscillator or gyrotron amplifier having a plurality of strong-field magnetic arrays disposed along the length of the device. Each magnetic array comprises n electromagnets, the windings of which are arranged so that the polarity of the electromagnets alternates around each array. Further, the polarity of the corresponding magnets in successive arrays alternate axially along the device. The strong-field magnetic arrays focus and reshape the electron beam within the gyrotron, thereby increasing the efficiency of the device. Permanent magnets may be used in lieu of electromagnets but offer less control.

2 Claims, 3 Drawing Figures

HIGH POWER GYROTRON (OSC) OR GYROTRON TYPE AMPLIFIER USING LIGHT WEIGHT FOCUSING FOR MILLIMETER WAVE TUBES

GOVERNMENT LICENSE

The invention described herein may be manufactured and used by or for the Government, for governmental purposes, without the payment of any royalties thereon or therefor.

TECHNICAL FIELD

Broadly speaking, this invention relates to microwave devices. More particularly, in a preferred embodiment, this invention relates to microwave devices of the gyrotron class.

DISCUSSION OF THE PRIOR ART

Considerable interest has been expressed recently in the use of millimeter wave and microwave energy for radar, satellite and terrestrial communications, etc. Unfortunately, existing microwave amplifiers and oscillators of the travelling wave tube, klystron and magnetron variety are not very efficient at such high frequencies and cannot operate at high power. As a result, attention has focussed on oscillators and amplifiers of the gyrotron class which can operate at higher power levels. Unfortunately, to achieve such higher power, existing gyrotron designs require strong axial magnetic fields over the entire length of the tube in order to achieve both the coupling and the cyclotron resonance conditions required to permit coupling of the electron beam and interaction circuits.

Unfortunately, the coupling of an electron-beam with rf circuits using only the axial magnetic field limits the interaction possible with appropriate transverse modes. This also limits the efficiency, bandwidth, and modulation capability of the structure.

SUMMARY OF THE INVENTION

Clearly, what is needed is a gyrotron device that uses the magnetic field to improve the coupling of the beam with the rf interaction circuit in addition to focussing the overall beam. Fortunately, these and other objectives are attained by the instant invention which, in a preferred embodiment, comprises an improved microwave device of the gyrotron class. The improved gyrotron is of a type that includes within an evacuated chamber means for generating a shaped electron beam, means for accelerating the electron beam towards the output end of the device, and at least one cavity along the major longitudinal axis of the device. More particularly, the improvement in this device comprises a plurality of strong-field magnetic focussing means periodically disposed along the major longitudinal axis of the device for reshaping and focussing the electron beam as it traverses the device thereby to increase the efficiency of the device.

The invention and its mode of operation will be more fully understood from the following detailed description when taken with the appended drawings, in which:

DETAILED DESCRIPTION OF THE INVENTION

Figure 1:
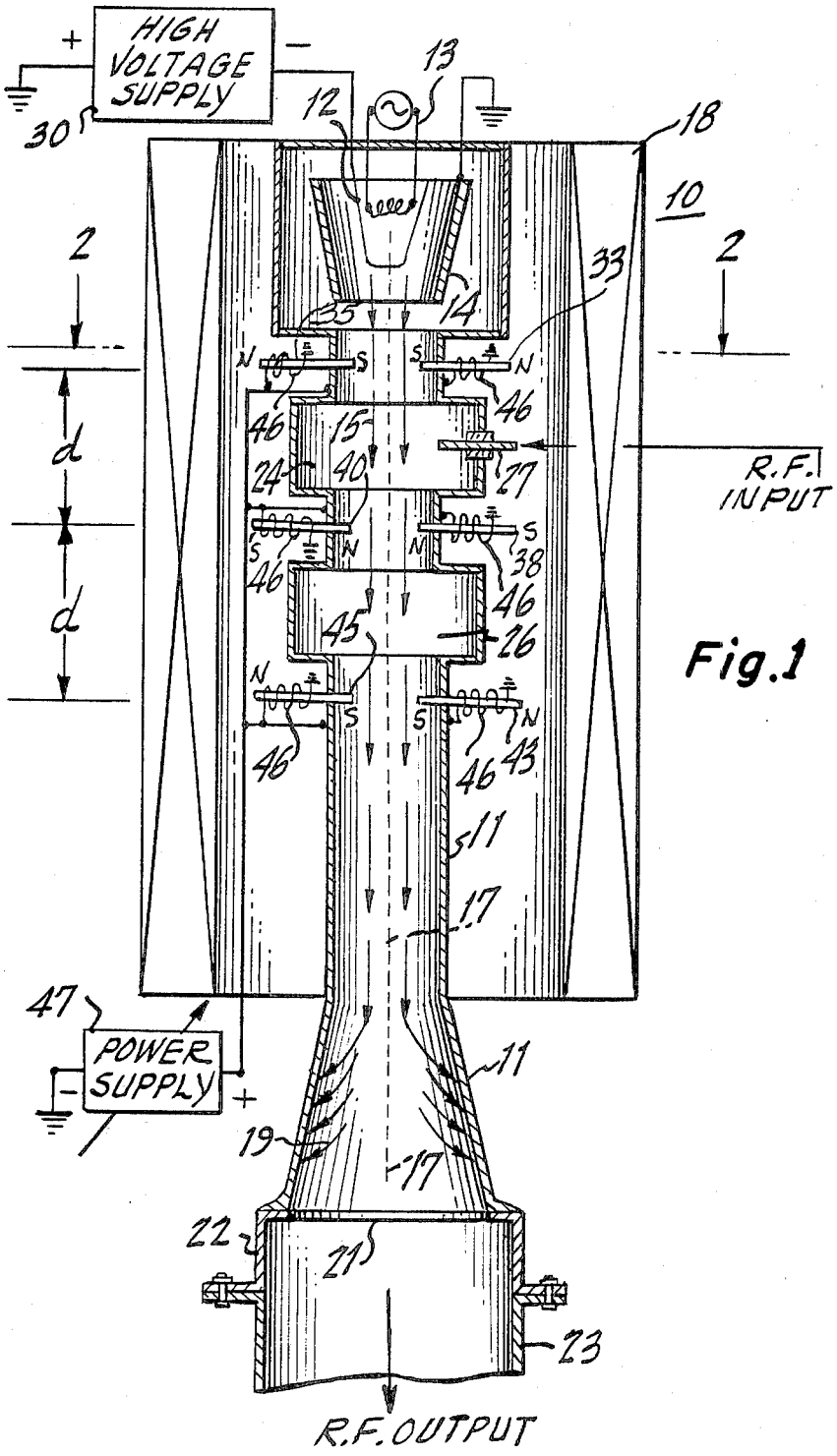
FIG. 1 is a cross-sectional view of an illustrative gyrotron device according to the invention.

FIG. 1 depicts an illustrative gyrotron amplifier according to the invention. One skilled in the art will appreciate that the instant invention is equally applicable to gyrotron type oscillators; therefore, these terms may be used interchangeably in the following description.

Figure 2:
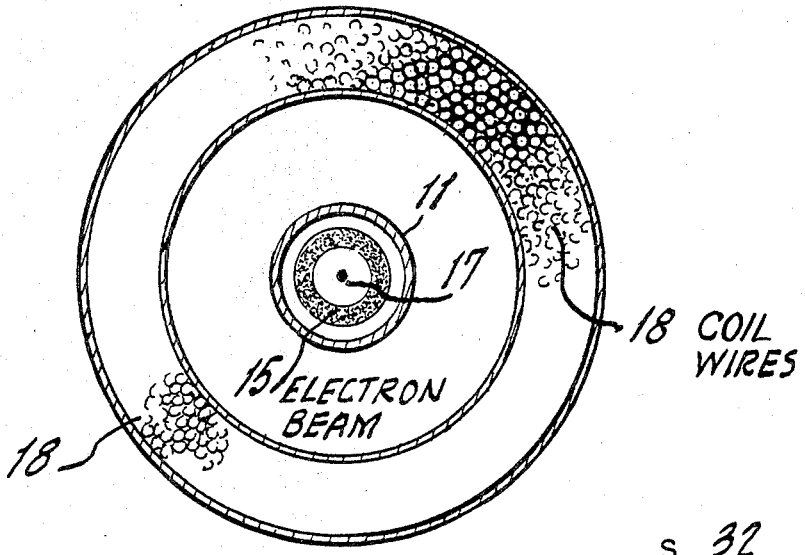
FIG. 2 is a partial, cross-sectional view of the amplifier shown in FIG. 1 which depicts the hollow, circular nature of the electron beam.

As shown, gyrotron 10 comprises an evacuated, nonferrous, e.g. copper, chamber 11 including a cathode 12 and a heater 13. A magnetron injection gun 14 is positioned within chamber 11, proximate cathode 12. The magnetron injection gun has a hollow, conical shape and, as best seen in FIG. 2, generates a hollow, cylindrical electron beam 15 which is coaxial with the principal longitudinal axis 17 of the device. A hollow, cylindrical solenoid 18, connected to some suitable source of DC current (not shown), focusses the beam generated by injection gun 14.

The lower end of gyrotron 10 includes a "window" 21 which is transparent to microwave energy and a flange 22 for coupling the tube to some suitable external device, e.g. waveguide 23. The other end of the gyrotron amplifier 10 includes a plurality of periodically spaced cavities, although only two such cavities, 24 and 26, are shown in the drawing to avoid clutter. Advantageously, the rf input to the gyrotron is made via cavity 24, for example by means of a probe loop or waveguide aperture 27 extending through the walls of the chamber. Of course, the rf output from the device is obtained through the previously discussed rf window 21. In the oscillator mode, only one cavity is utilized.

Injection gun 14 is grounded and some suitable high-voltage power supply 30 has its positive lead connected to ground and its negative lead connected to cathode 12. As shown by arrows 19, electron beam 15 is collected on the walls of chamber 11 at the bottom end of the device, proximate window 21.

Figure 3:
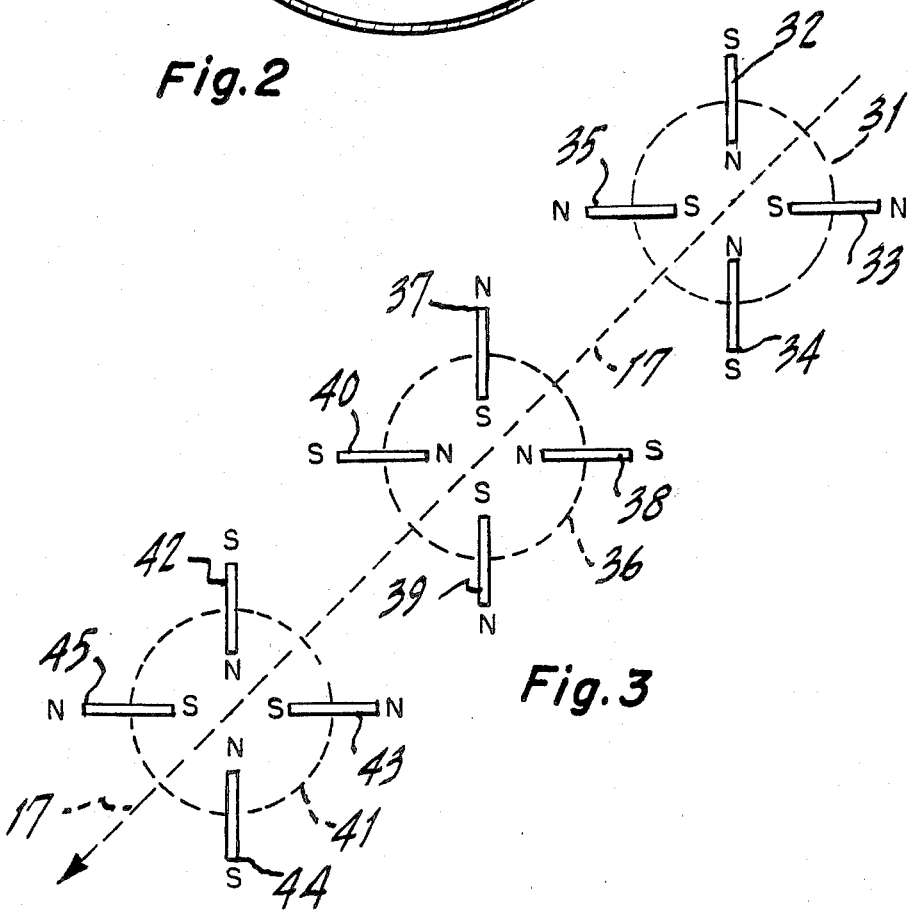
FIG. 3 is a schematic, isometric view of the arrangement of magnetic poles in the gyrotron device shown in FIG. 1.

According to the invention, gyrotron 10 includes a plurality of strong-field, focussing magnet arrays which are periodically spaced along the length of the tube. In the illustrative embodiment, these focussing magnets are quadrupoles but, in general, any n-pole array will work, where n is even and $n \geqq 4$. As best seen in FIG. 3, the first quadrupole array 31 comprises four discrete electromagnets 32–35, the second array 36 comprises electromagnets 37–40 and the third array 41 comprises electromagnets 42–45. Of course, in the cross-sectional view of FIG. 1, not all of these magnets are visible. One skilled in the art will realize that permanent magnets may be substituted for the electromagnets shown, if desired, but in view of the balanced strong-field needed, electromagnets are preferred. Further, by varying the strength of the magnetizing current in the field windings of the electromagnets, far greater control may be achieved over the operation of the device.

Returning to FIG. 1, each electromagnet is furnished with a field winding 46 which is connected between ground and some suitable adjustable source of DC current 47. Of course, the cores of the electromagnets are manufactured from a ferromagnetic material, e.g. soft iron, and the cores are mounted so that the ends of the cores penetrate into the gyrotron thereby to affect the path of electron beam 15. Advantageously, the penetration of the magnetic cores brings them as close as possible to the electron beam, without actually intercepting it.

A suitable braze (not shown) is used to insure that the vacuum integrity of gyrotron 10 is not broken by the penetration of the magnetic cores. As best seen in FIG. 3, the field windings 46 are arranged so that the polarity of each magnet alternates around a given array and, further, precesses from array to array. Thus, for quadrupole array 31, for example, the sequence is N-S-N-S while for quadrupole array 36, the corresponding sequence is S-N-S-N, etc. While only three magnetic arrays are shown, an actual gyrotron device would have m arrays each comprising n alternating magnetic poles. The spacing d between arrays is, of course, a function of the intercavity spacing, itself a function of the frequency at which the device operates.

As is well known, in gyrotron-type tubes, the rf interaction takes place within the cavity. Loosely speaking, the function of the periodic arrays of strong field focussing magnets is to "hold the beam together" between cavities. As previously mentioned, the beam starts out as a hollow, circular beam but the first strong field focussing array converts the beam into an elliptically shaped beam. The major axis of the ellipse will change orientation as the beam progresses down the tube due, of course, to the alternating orientation of the magnetic field produced by the remaining magnetic arrays.

The disclosed arrangement permits superior control of the beam shape, which will ultimately provide the high tube efficiency desired. The addition of the quadrupole magnetic arrays improves the coupling efficiency of the beam with the circuit fields. The number of possible modes in the rf interaction structure is increased, making possible performance options previously unobtainable. The magnetic field provided by the invention comprises a control means for switching the device for modulation purposes. In addition, the field increases the bandwith capability of the structure.

One skilled in the art may make various changes and substitutions of the layout of parts shown without departing from the spirit and scope of the invention.

What is claimed is:

1. A microwave gyrotron tube comprising:

an evacuated elongated chamber;

a cathode located at one end of said chamber;

an injection gun located at said one end of said chamber including means for injecting a hollow, circular cylindrical electron beam into said chamber coaxial with the principal longitudinal axis thereof;

a solenoid means mounted around said tube for providing a longitudinal magnetic field in said chamber for focussing said electron beam;

said chamber including at least one r-f input cavity mounted in the path of said beam and said cavity having means for coupling r-f gyrotron energy to said beam;

the other end of said tube including a means for collecting said electron beam and a means for coupling microwave energy out of said tube;

at least one strong-field quadrupole magnetic means in said chamber adjacent to said electron beam and located between said injection gun and said cavity for reshaping said electron beam into a hollow elliptical electron beam; and said quadrupole magnetic means including four magnets having poles extending into said chamber adjacent to said electron beam and being symetrically spaced about said beam in a plane perpendicular to said longitudinal axis with the adjacent ones of said poles having opposite polarities.

2. The tube according to claim 1 further comprising a plurality of said cavities periodically spaced along said longitudinal axis and interleaved with a plurality of said strong-field magnetic means.

* * * * *